US010774294B2

(12) United States Patent
Piorkowski

(10) Patent No.: US 10,774,294 B2
(45) Date of Patent: Sep. 15, 2020

(54) STABLE UNIT DOSE COMPOSITIONS

(71) Applicant: Henkel IP & Holding GmbH, Duesseldorf (DE)

(72) Inventor: Daniel Thomas Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 78 days.

(21) Appl. No.: 15/956,150

(22) Filed: Apr. 18, 2018

(65) Prior Publication Data

US 2018/0334641 A1 Nov. 22, 2018

Related U.S. Application Data

(60) Provisional application No. 62/507,648, filed on May 17, 2017.

(51) Int. Cl.

| | |
|---|---|
| ***C11D 17/04*** | (2006.01) |
| ***C11D 1/22*** | (2006.01) |
| ***C11D 1/29*** | (2006.01) |
| ***C11D 1/72*** | (2006.01) |
| ***C11D 1/722*** | (2006.01) |
| ***C11D 1/83*** | (2006.01) |
| ***C11D 3/43*** | (2006.01) |
| ***C11D 1/65*** | (2006.01) |
| *C11D 3/20* | (2006.01) |
| *C11D 3/34* | (2006.01) |
| *C11D 3/37* | (2006.01) |

(52) U.S. Cl.

CPC ..... *C11D 17/043* (2013.01); *C11D 1/65* (2013.01); *C11D 1/83* (2013.01); *C11D 3/43* (2013.01); *C11D 1/22* (2013.01); *C11D 1/29* (2013.01); *C11D 1/72* (2013.01); *C11D 3/2044* (2013.01); *C11D 3/2048* (2013.01); *C11D 3/2065* (2013.01); *C11D 3/2068* (2013.01); *C11D 3/3409* (2013.01); *C11D 3/3707* (2013.01)

(58) Field of Classification Search

None

See application file for complete search history.

(56) References Cited

U.S. PATENT DOCUMENTS

| | | | | |
|---|---|---|---|---|
| 3,218,776 | A | 11/1965 | Cloud | |
| 3,308,067 | A | 3/1967 | Diehl | |
| 3,453,779 | A | 7/1969 | Reifenberg | |
| 4,291,071 | A | 9/1981 | Harris et al. | |
| 4,375,416 | A | 3/1983 | Crisp et al. | |
| 4,663,071 | A | 5/1987 | Bush et al. | |
| 4,776,455 | A | 10/1988 | Anderson et al. | |
| 4,786,431 | A | 11/1988 | Broze et al. | |
| 5,616,781 | A | 4/1997 | Sajic et al. | |
| 5,699,653 | A | 12/1997 | Hartman et al. | |
| 5,722,217 | A | 3/1998 | Cloud | |
| 5,958,864 | A | 9/1999 | Artiga Gonzalez et al. | |
| 6,024,943 | A | 2/2000 | Ness et al. | |
| 6,037,319 | A | 3/2000 | Dickler et al. | |
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 6,727,215 | B2 | 4/2004 | Roberts et al. | |
| 6,764,992 | B2 | 7/2004 | Kumar et al. | |
| 6,878,679 | B2 | 4/2005 | Sommerville-Roberts et al. | |
| 7,259,134 | B2 | 8/2007 | Beckholt et al. | |
| 7,282,472 | B2 | 10/2007 | Kapur et al. | |
| 7,304,025 | B2 | 12/2007 | Hardy et al. | |
| 7,329,441 | B2 | 2/2008 | Catlin et al. | |
| 7,439,215 | B2 | 10/2008 | Catlin et al. | |
| 7,464,519 | B2 | 12/2008 | Fisher et al. | |
| 7,595,290 | B2 | 9/2009 | Pounds et al. | |
| 8,426,353 | B2 | 4/2013 | Ouali et al. | |
| 2011/0214696 | A1 | 9/2011 | Schneiderman et al. | |
| 2011/0224127 | A1 | 9/2011 | Blyth et al. | |
| 2011/0319311 | A1* | 12/2011 | Labeque | C11D 3/2079 510/296 |
| 2014/0274861 | A1* | 9/2014 | Petrovicova | C11D 17/0013 510/304 |
| 2014/0319015 | A1* | 10/2014 | Sunder | C11D 3/2041 206/525 |
| 2014/0323383 | A1* | 10/2014 | Trujillo | C11D 17/0039 510/439 |
| 2016/0024440 | A1 | 1/2016 | Simonsen et al. | |
| 2016/0355755 | A1* | 12/2016 | Brooker | C11D 1/22 |
| 2016/0355767 | A1* | 12/2016 | Souter | C11D 3/50 |
| 2017/0283748 | A1* | 10/2017 | Caires | C11D 3/43 |
| 2019/0085273 | A1* | 3/2019 | Gutowski | C11D 3/349 |

FOREIGN PATENT DOCUMENTS

| | | | |
|---|---|---|---|
| EP | 0193360 | A2 | 9/1986 |
| KR | 10-1998-0070424 | A | 10/1998 |
| KR | 10-2016-0079676 | A | 7/2016 |

OTHER PUBLICATIONS

PCT International Search Report PCT/US2018/027290 completed: Aug. 1 2018; dated Aug. 1, 2018 11 pages.

* cited by examiner

*Primary Examiner* — Lorna M Douyon
(74) *Attorney, Agent, or Firm* — Bojuan Deng

(57) ABSTRACT

The present disclosure provides stable unit dose compositions with enhanced pack rigidity. Such unit dose compositions comprise a liquid composition having at least four non-aqueous solvents, a beneficial composition, and a water-soluble container formed from a water-soluble or water-dispersible film material.

18 Claims, No Drawings

STABLE UNIT DOSE COMPOSITIONS

FIELD OF INVENTION

This invention is in the fields of household and industrial cleaning. More particularly, the invention relates to stable unit dose compositions with enhanced pack rigidity. Such unit dose compositions comprise a liquid composition having at least four non-aqueous solvents, a water, a beneficial composition, and a water-soluble container formed from a water-soluble or water-dispersible film material.

BACKGROUND OF THE INVENTION

Unit dose detergent products are often found by consumers to be preferable for use in automatic dishwashing and laundry applications. Such unit dose products have several advantages, including convenience of use and dispensing, lower cost per use, and avoiding or minimizing skin contact with potentially irritating cleaning compositions.

In unit dose formulations with high solvent content, e.g., over 30% wt of total added solvent on the weight of the entire formulation, it is difficult to maintain pack rigidity in multi-chamber products using polyvinyl alcohol (PVOH) or polyvinyl acetate (PVA) film. With increased solvent content, the weight of the liquid composition in the compartment of multi-chamber product makes it 'sag' down, making the unit dose composition appear 'floppy'. Moreover, such unit dose compositions may suffer from unexpected rupturing. This is due to the weight of one compartment putting undue load pressure on the film causing it to overstretch and rupture which will lead to leakage or breakage.

Traditional formulas have included a total of three solvents. The most commonly used solvent system includes water, glycerin, and propylene glycol. Recently, an ionic liquid has also been employed as a solvent.

There remains a need in the art for a unit dose composition with high solvent content while maintaining pack integrity such as rigidity and stability.

It was surprisingly found that employing a solvent system that employs at least five solvents, e.g., glycol ethers, polyethylene glycols, or diols, stabilizes the unit dose system and enhances rigidity to an acceptable level despite the much higher solvent content. This invention shows the benefit of a structured solvent system with five different solvents and how it improves pack rigidity (i.e. height) by up to 15%, which is extremely significant. Overall benefit to the consumer is a more stable unit dose pack that is less prone to leakage or breakage, and one that is more aesthetically pleasing during handling.

BRIEF SUMMARY OF THE INVENTION

The present disclosure provides a unit dose composition, comprising: (a) a container formed from a water-soluble or water-dispersible film material; and (b) a liquid composition comprising: (i) a solvent system comprising water and at least four non-aqueous solvents, said solvent system totals from about 35% to about 80% weight of the liquid composition; and (ii) a beneficial composition; wherein the water-soluble or water-dispersible film forms a container that entraps the liquid composition.

In some embodiments, the at least four non-aqueous solvents are chosen from polyols, ionic liquids, glycol ethers, ethylene oxide/propylene oxide (EO/PO) block copolymers, polyethylene glycols, and mixtures thereof.

In some embodiments, the solvent system includes two polyols.

In some embodiments, the two polyols are propylene glycol and glycerin.

In some embodiments, the liquid composition comprises from about 35% to about 80%, preferably from about 37.5% to about 70%, more preferably from about 40% to about 65%, and most preferably from 50% to about 60% by weight of the solvent system.

In some embodiments, the liquid composition comprises from about 5% to about 40%, preferably from about 7.5% to about 30%, and more preferably from about 10% to about 25% by weight of water.

In some embodiments, the liquid composition comprises from about 25% to about 75%, preferably from about 25% to about 50%, and more preferably from about 27.5% to about 40% by weight of combined non-aqueous solvents.

In some embodiments, the solvent system includes one or more polyols chosen from propylene glycol, 2-methyl 1,3-propanediol, 1,3-propanediol, 1,5-pentanediol, glycerin, hexylene glycol.

In some embodiments, the solvent system includes an ionic liquid, and the ionic liquid is tris (2-hydroxyethyl) methyl ammonium methylsulfate.

In some embodiments, the solvent system includes one or more glycol ethers chosen from ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, triethylene glycol monomethyl ether.

In some embodiments, the solvent system includes one or more EO/PO block copolymers, and the molecular weight of the EO/PO block copolymer is less than 3500, with the EO portion at least 60% of the EO/PO molecule, preferably greater than 70%, and most preferably greater than 80%.

In some embodiments, the solvent system includes one or more polyethylene glycols, and the polyethylene glycol is PEG 300, PEG 400, PEG 600, PEG 800, PEG 1000, or a mixture thereof.

In some embodiments, the solvent system comprises: (a) water; (b) one or more polyols; and (c) two or more non-aqueous solvents chosen from polyols, ionic liquids, glycol ethers, EO/PO block copolymers, polyethylene glycols, and mixtures thereof.

In some embodiments, the solvent system comprises: (a) water; (b) one or more polyols; and (c) an ionic liquid or one or more polyethylene glycols, or a mixture thereof.

In some embodiments, the weight ratio of any one solvent to another solvent is from 1:6 to 6:1, preferably from 1:4 to 4:1, and most preferably from 1:3 to 3:1.

In some embodiments, the polyols are present at about 1 to 5 times, preferably about 2 to 4 times, and more preferably about 2 times by weight of any other non-aqueous solvents.

In some embodiments, the ionic liquid or PEG is present at about 2 to 5 times, preferably about 2 to 4 times, and more preferably about 3 times by weight of any other non-aqueous solvent.

In some embodiments, any non-aqueous solvent is no more than 30%, preferably no more than 25%, and more preferably no more than 20% by weight of the liquid composition.

In some embodiments, the beneficial composition comprises a surfactant system, a fragrance composition, a color care agent, a softening agent, or a combination thereof.

In some embodiments, the surfactant system comprises an anionic surfactant, a nonionic surfactant, a cationic surfactant, an ampholytic surfactant, a zwitterionic surfactant, or a mixture thereof.

In some embodiments, the anionic surfactant is a sulfate anionic surfactant.

In some embodiments, the sulfate anionic surfactant is an alkyl ether sulfate (AES).

In some embodiments, the sulfate anionic surfactant is sodium lauryl ether sulfate (SLES).

In some embodiments, the liquid composition comprises from about 10 wt % to about 65 wt % of one or more surfactants, preferably from about 15 wt % to about 60 wt %, more preferably from about 20 wt % to about 55 wt %, and most preferably from about 30 wt % to about 50 wt %.

In some embodiments, the nonionic surfactant is selected from the group consisting of polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof.

In some embodiments, the surfactant system comprises an anionic surfactant and a non-ionic surfactant.

In some embodiments, the surfactant system further comprises a defoamer.

In some embodiments, the surfactant system further comprises a zwitterionic surfactant or an amphoteric surfactant.

In some embodiments, the surfactant system is present in an amount of about 0.1% to 70%, preferably about 30% to 60%, and more preferably about 40% to 50% by weight.

In some embodiments, the anionic surfactant and the non-ionic surfactant are present in a weight ratio of about 1:9 to 9:1, preferably about 3:7 to 7:3, and more preferably about 4:6 to 6:4.

In some embodiment, the beneficial composition comprises a surfactant system, comprising: (a) a linear alkylbenzene sulfonate (LAS) and/or an alcohol ethoxylsulfate (AES), (b) an alcohol ethoxylate (AE), and (c) a fatty acid.

In some embodiments, the LAS is present in an amount of about 10% to about 20% by weight of the surfactant system.

In some embodiments, the AES is present in an amount of about 20% to about 40% by weight of the surfactant system.

In some embodiments, the AE is present in an amount of about 30% to about 70% by weight of the surfactant system.

In some embodiments, the fatty acid is present in an amount of about 1% to about 15% by weight of the surfactant system.

In some embodiments, the LAS and the AES are present in a weight ratio of from about 1:1 to about 1:5 (e.g., about 1:2.5).

In some embodiments, the LAS and the AE are present in a weight ratio of from about 1:1 to about 1:10 (e.g., about 1:4).

In some embodiments, the LAS and the fatty acid are present in a weight ratio of from about 6:1 to about 1:1 (e.g., about 3:1).

In some embodiments, the weight ratio of LAS:AES:AE is about 0.9-1.1:1.8-2.2:2.7-3.3 (e.g., about 1:2:3).

In some embodiments, the liquid composition is substantially free of a sulphate surfactant.

In some embodiments, the fragrance composition comprises a neat oil, an encapsulated fragrance, an oil-in-water emulsion, or a combination thereof.

In some embodiments, the fragrance composition is present in an amount from about 0.1% to about 50% by weight, preferably about 0.1% to about 15% by weight.

In some embodiments, the liquid composition further comprises a surfactant stabilizer. Examples of the surfactant stabilizer include, but are not limited to, polysorbate, quillaja extract, octenyl succinic anhydride (OSA) modified starch, gum acacia, modified gum acacia, and a mixture thereof.

In some embodiments, the liquid composition further comprises a neutralization agent. The neutralization agent comprises a hydroxide, an alkanolamine, or a mixture thereof. Examples of the neutralization agent include, but are not limited to, monoethanolamine, diethanolamine, triethanolamine, isopropylamine, sodium hydroxide, potassium hydroxide, ammonium hydroxide, calcium hydroxide, or the like, and a mixture thereof.

In some embodiments, the water-soluble or water-dispersible film material is selected from the group consisting of polyvinyl alcohol (PVOH), polyvinyl acetate (PVA), film forming cellulosic polymer, polyacrylic acid, polyacrylamide, polyanhydride, polysaccharide, polyvinyl pyrrolidone, polyalkylene oxide, cellulose, cellulose ether, cellulose ester, cellulose amide, polyvinyl acetate, polycarboxylic acid and salt, polyaminoacid, polyamide, natural gums, polyacrylate, water-soluble acrylate copolymer, methylcellulose, carboxymethylcellulose sodium, dextrin, ethylcellulose, hydroxyethyl cellulose, maltodextrin, polymethacrylate, polyvinyl alcohol copolymer, and hydroxypropyl methyl cellulose (HPMC), or a mixture thereof.

In some embodiments, the water-soluble or water-dispersible film material is polyvinyl alcohol (PVOH) or polyvinyl acetate (PVA).

In some embodiments, the water-soluble or water-dispersible film material is between about 50 to about 120 microns thick, preferably about 60 to about 100 microns.

DETAILED DESCRIPTION OF THE INVENTION

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing, or fabricating techniques conventionally used in the detergent industry. Moreover, the processes below describe only steps, rather than a complete process flow, for manufacturing the aqueous surfactant system and unit dose composition containing the aqueous surfactant system according to the present invention.

As used herein, "a," "an," or "the" means one or more unless otherwise specified.

The term "or" can be conjunctive or disjunctive.

Open terms such as "include," "including," "contain," "containing" and the like mean "comprising."

As used herein, the terms "pouch", "pack" and "pac" can be used interchangeably.

As used herein, the terms "pouch", "pack" and "pac" can have one or two or multi-compartment.

As used herein, the term "stable" means that the pac maintains its rigidity and film integrity without breakage and/or leakage.

As used herein, the terms "solvent," "solvents," and "solvent system," mean a liquid or liquids used to dissolve or solvate other chemicals. In some cases, materials can also be dispersed within the solvent (i.e., Titanium Dioxide in water). In other cases, a solvent (i.e., solvent A) can initially exist as a solid and then be dissolved within solvent B, so solvent A can then act as a solvent itself (i.e., PEG 3350 in water). As used herein, the terms "solvent," "solvents," and "solvent system," do not include neutralization agents, such as, e.g., triethanolamine, monoethanolamine, and sodium hydroxide.

As used herein, the term "at least four non-aqueous solvents" means four, five, six, seven, eight, nine or more non-aqueous solvents (i.e., solvents that are not water).

As used herein, the term "about" includes the recited number ±10%. For example, "about 10" means 9 to 11.

As used herein, the phrase "substantially free of" means that a composition contains little no specified ingredient/component, such as less than about 5 wt %, 4 wt %, 3 wt %, 2 wt %, 1 wt %, 0.5 wt %, or 0.1 wt %, or below the detectable level of the specified ingredient. For example, the phrase "substantially free of a sulphate surfactant" refers to a liquid composition of the present disclosure that contains little or no sulphate surfactant.

As used herein, the "%" described in the present disclosure refers to the weight percentage unless otherwise indicated.

Unit Dose Composition

In one aspect, the present disclosure provides a unit dose composition comprising a container and a liquid composition. The container may be a pouch or a pack that comprises a water-soluble or water-dispersible film, which fully encloses the liquid composition in at least one compartment. In some embodiments, the pouch or the pack comprises two compartments. The water-soluble or water-dispersible container (e.g., pouch or pack) of the present disclosure may be in any desirable shape and size, e.g., square, rectangular, oval, elliptoid, superelliptical, or circular shape.

The unit dose composition is suitable for cleaning fabrics or dishes, or providing fabric care benefits or sensorial benefits (such as a fragrance booster, softening, malodor control, whitening, and color protection) to fabrics.

Container

In some embodiments, the container of the unit dose composition is made from a water-soluble or water-dispersible material that dissolves, ruptures, disperses, or disintegrates upon contact with water, thereby releasing the composition or cleaning system contained within the container. In preferred embodiments, the water-soluble or water-dispersible container, which may be in the form of a pouch, is formed from a water soluble polymer. Non-limiting examples of suitable water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, film forming cellulosic polymer, polyanhydride, polysaccharide, polyalkylene oxide, cellulose, cellulose ester, cellulose amide, polyvinyl acetate, polycarboxylic acid and salt, polyamino-acid, polyamide, natural gums, polyacrylate, water-soluble acrylate copolymer, methylcellulose, carboxymethylcellulose sodium, dextrin, ethylcellulose, maltodextrin, polymethacrylate, polyvinyl alcohol copolymer, and mixtures thereof.

In some embodiments, the water-soluble or water-dispersible film material of the container can be polyvinyl alcohol (PVOH), polyvinyl acetate (PVA), film forming cellulosic polymer, polyacrylic acid, polyacrylamide, polyanhydride, polysaccharide, or a mixture thereof. In some embodiments, the water-soluble or water-dispersible film material is polyvinyl alcohol (PVOH) or polyvinyl acetate (PVA).

In one embodiment, the water-soluble or water-dispersible container is made from a lower molecular weight water-soluble polyvinyl alcohol (PVOH) film-forming resin.

Suitable PVOH resins are those having a weight average molecular weight range of about 55,000 to 65,000 and a number average molecular weight range of about 27,000 to 33,000. In some embodiments, the film material will have a thickness of approximately 3 mil or 75 micrometers.

In some embodiments, the water-soluble or water-dispersible container may further contain a cross-linking agent, e.g., a cross-linking agent selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmetacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zireonates, or mixtures thereof. In one embodiment, the cross-linking agent is boric acid or sodium borate.

In some embodiments, the water-soluble or water-dispersible container can have a protective layer between the film polymer and the composition in the container. In some embodiments, the protective layer may comprise polytetrafluoroethylene (PTFE).

In some embodiments, the water-soluble or water-dispersible film material is between about 50 to about 120 microns thick, preferably about 60 to about 100 microns. In some embodiments, the water-soluble or water-dispersible film material has a thickness of from about 50 to about 120 microns, from about 50 to about 100 microns, from about 50 to about 80 microns, from about 50 to about 60 microns, from about 60 to about 120 microns, from about 60 to about 100 microns, from about 60 to about 80 microns, or from about 60 to about 70 microns.

In some embodiments, the unit dose composition may optionally comprise additional compartments, which may comprise an additional composition. The additional composition may be liquid, solid, or mixtures thereof. Alternatively, any additional solid components may be suspended in a liquid-filled compartment. Each compartment may have the same or different compositions.

The water-soluble or water-dispersible container (e.g., pouch) of the present disclosure may be prepared in any suitable way, such as via molding, casting, extruding or blowing, and is then filled using an automated filling process. Examples of processes for producing and filling water-soluble containers, suitable for use in accordance with the present disclosure, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290, each of which is incorporated herein by reference in its entirety.

Liquid Composition

In some embodiments, the unit dose composition comprises a liquid composition comprising: (i) a solvent system comprising water and at least four non-aqueous solvents, said solvents system totals from about 35% to about 80% weight of the liquid composition; and (ii) a beneficial composition. In some embodiments, the beneficial composition comprises a surfactant system, a fragrance composition, a color care agent, a softening agent, or a combination thereof.

In some embodiments, the solvent system comprises: water and four non-aqueous solvents; water and five non-aqueous solvents; water and six non-aqueous solvents; water and seven non-aqueous solvents; water and eight non-aqueous solvents; water and nine non-aqueous solvents; and water and ten non-aqueous solvents.

Solvent System

The liquid composition may comprise greater than 35 wt %, greater than 37.5 wt %, greater than 40 wt %, or greater than 50 wt % of solvents, based on the total weight of the liquid composition. The liquid composition may comprise less than 80 wt %, less than 70 wt %, less than 65 wt %, or less than 60 wt % of solvents, based on the total weight of the liquid composition. In some embodiments, the liquid composition comprises from about 35% to about 80%, preferably from about 37.5% to about 70%, more preferably from about 40% to about 65%, and most preferably from about 50% to about 60% by weight of solvents, based on the total weight of the liquid composition.

Non-Aqueous Solvents

The liquid composition may comprise greater than 25 wt %, or greater than 27.5 wt % of non-aqueous solvents, based on the total weight of the liquid composition. The liquid composition may comprise less than 40 wt %, less than 50 wt %, or less than 75 wt % of non-aqueous solvents based on the total weight of the liquid composition. In some embodiments, the liquid composition comprises from about 25% to about 75%, preferably from about 25% to about 50%, and more preferably from about 27.5% to about 40% by weight of non-aqueous solvents, based on the total weight of the liquid composition.

In some embodiments, any non-aqueous solvent is no more than 30%, preferably no more than 25%, and more preferably no more than 20% by weight of the liquid composition.

In some embodiments, the non-aqueous solvents are chosen from polyols, ionic liquids, glycol ethers, EO/PO block copolymers, polyethylene glycols, and mixtures thereof.

Polyols

In some embodiments, the solvent system comprises polyols. The polyol (or polyhydric alcohol) may be a linear or branched alcohol with two or more hydroxyl groups. Thus diols with two hydroxyl groups attached to separate carbon atoms in an aliphatic chain may also be used. The polyol typically includes less than 9 carbon atoms, such as 9, 8, 7, 6, 5, 4, 3, or 2 carbon atoms. Preferably, the polyol includes 3 to 8 carbon atoms. More preferably, the polyol includes 3 to 6 carbon atoms. The molecular weight is typically less than 500 g/mol, such as less than 400 g/mol or less than 300 g/mol.

Examples of suitable polyols include, but not limited to, propylene glycol, butylene glycol, pentylene glycol, hexylene glycol, heptylene glycol, octylene glycol, 2-methyl-1,3-propanediol, xylitol, sorbitol, mannitol, diethylene glycol, triethylene glycol, glycerol, erythritol, dulcitol, inositol, and adonitol.

The liquid compositions of the present invention may contain 1% to about 30% of one or more polyols, preferably from about 5% to about 25%, and more preferably from about 10% to about 20% by weight of the entire formulation.

In some embodiments, the polyols are present at about 1 to 5 times, preferably about 2 to 4 times, and more preferably about 2 times by weight of any other non-aqueous solvents.

Ionic Liquids

In some embodiments, the solvent system comprises ionic liquids. The ionic liquid may include anion and cation combinations having the formulas:

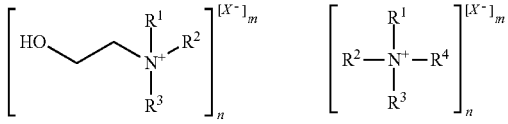

wherein are chosen from linear or branched, substituted or unsubstituted, alkyl, aryl, alkoxyalkyl, alkylenearyl hydroxyalkyl, or haloalkyl; wherein X is an anion such as those described hereinabove; wherein m and n are chosen to provide electronic neutrality; and wherein the ionic liquids are water immiscible when at least one of $R^1$-$R^4$ is $C_{12}$ or higher; or at least two of $R^1$-$R^4$ are $C_{10}$ or higher; or at least three of $R_1$-$R_4$ are $C_6$ or higher.

In some embodiments, the ionic liquid includes a cation chosen from trimethyloctyl ammonium cation, triisooctylmethyl ammonium cation, tetrahexyl ammonium cation, tetraoctyl ammonium cation, and mixtures thereof, and an anion chosen from those described hereinabove.

In some embodiments, the ionic liquids include amine oxide cations and an anion chosen from those described hereinabove. In additional embodiments, the ionic liquids include betaine cations and an anion chosen from those described hereinabove.

In some embodiments, the liquid compositions of the present invention may contain from about 1% to about 30% one or more ionic liquids, preferably from about 5% to about 25%, and more preferably from about 10% to about 20% by weight of the entire formulation.

Glycol Ethers

In some embodiments, the solvent system comprises glycol ethers. Examples of suitable glycol ethers include, but not limited to, ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether.

In some embodiments, the liquid compositions of the present invention may contain 1% to about 30% of one or more glycol ethers, preferably from about 2% to about 10%, and more preferably from about 4% to about 6% by weight of the entire formulation.

EO/PO Block Polymers

In some embodiments, the solvent system comprises EO/PO block polymers, such as those marketed under the tradename Pluronic. These materials are formed by adding blocks of ethylene oxide moieties to the ends of polypropylene glycol chains to adjust the surface active properties of the resulting block polymers.

In some embodiments, the liquid compositions of the present invention may contain about 1% to about 30% of one or more EO/PO block copolymers, preferably from about 2% to about 10%, and more preferably from about 4% to about 6% by weight of the entire formulation. In some embodiments, molecular weight of the EO/PO block copolymer is less than 3500, with the EO portion at least 60% of the EO/PO molecule, preferably greater than 70%, and most preferably greater than 80%.

Polyethylene Glycol (PEG)

In some embodiments, the solvent system comprises polyethylene glycol ("PEG"). The PEG can have a weight average molecular weight ranging, for example, from about 300 to about 3000. Suitable PEGs can have a weight average molecular weight of, for example, about 300, about 400, about 500, about 600, about 700, about 800, about 900, about 1000, about 1100, about 1200, about 1300, about 1400, about 1500, about 1600, about 1700, about 1800, about 1900, about 2000, about 2100, about 2200, about 2300, about 2400, about 2500, or about 2600, about 2700, about 2800, about 2900, or about 3000.

In some embodiments, the liquid compositions of the present invention may contain 1% to about 30% of one or more PEGs, preferably from about 2% to about 25%, more preferably from about 4% to about 20%, and most preferably from about 6% to about 18% by weight of the entire formulation.

In some embodiments, the ionic liquid or PEG is present at about 2 to 5 times, preferably about 2 to 4 times, and more preferably about 3 times by weight of any other non-aqueous solvent.

Water

The liquid composition may comprise greater than 5 wt %, greater than 7.5 wt %, or greater than 10 wt % of added water, based on the total weight of the liquid composition. The liquid composition may comprise less than 30 wt %, less than 25 wt %, or less than 20 wt % by weight of added water, based on the total weight of the liquid composition. In some embodiments, the liquid composition comprises from about 5% to about 30%, preferably from about 7.5% to about 25%, and more preferably from about 10% to about 20% by weight of added water, based on the total weight of the liquid composition.

The liquid composition may comprise greater than 5 wt %, greater than 7.5 wt %, or greater than 10 wt % of total water, based on the total weight of the liquid composition. The liquid composition may comprise less than 40 wt %, less than 30 wt %, or less than 25 wt % by weight of total water, based on the total weight of the liquid composition. In some embodiments, the liquid composition comprises from about 5% to about 40%, preferably from about 7.5% to about 30%, and more preferably from about 10% to about 25% by weight of total water, based on the total weight of the liquid composition.

In some embodiments, the weight ratio of any one solvent to another solvent is from 1:6 to 6:1, preferably from 1:4 to 4:1, and most preferably from 1:3 to 3:1.

Beneficial Composition

The liquid composition comprises a beneficial composition. As used herein, the term "beneficial composition" means a surfactant system, a fragrance composition, a color care agent, a softening agent, or a combination thereof.

In one embodiment, the beneficial composition is a surfactant system.

In some embodiments, additional ingredients can be added to the beneficial composition, including one or more of the following non-limiting ingredients: a whitening agent, a brightening agent, a color/texture rejuvenating agent, a bleaching catalyst, a bleaching agent, a bleach activator, a buffer, a surfactant stabilizer, a neutralization agent, a builder, an enzyme, a dye (colorant), a dispersing agent, a defoamer, an anticorrosion agent, a deodorizing agent, an anti-redeposition agent, a soil releasing polymer, a preservative, a bittering agent, a biocidal agent, or a combination thereof.

Surfactant System

In some embodiments, the surfactant system in the liquid composition of the present invention includes, for example, an anionic surfactant, a nonionic surfactant, a cationic surfactant, an ampholytic surfactant, a zwitterionic surfactant, or mixtures thereof.

Suitable anionic surfactants include, but are not limited to, those surfactants that contain a long chain hydrocarbon hydrophobic group in their molecular structure and a hydrophilic group, i.e., water solubilizing group including salts such as carboxylate, sulfonate, sulfate, or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group.

In some embodiments, the anionic surfactant is a polyethoxylated alcohol sulfate. Such materials, also known as alkyl ether sulfates (AES) or alkyl polyethoxylate sulfates, are those which correspond to the following formula (I):

$$R'—O—(C2H4O)n\text{-}SO3M' \quad (I)$$

wherein R' is a $C_8$-$C_{20}$ alkyl group, n is from 1 to 20, and M' is a salt-forming cation, preferably, R' is $C_{10}$-$C_{18}$ alkyl, n is from 1 to 15, and M' is sodium, potassium, ammonium, alkylammonium, or alkanolammonium. In another embodiment, R' is a $C_{12}$-$C_{16}$ alkyl, n is from 1 to 6 and M' is sodium. In another embodiment, the alkyl ether sulfate is sodium lauryl ether sulphate (SLES).

Suitable nonionic surfactants include, but are not limited to, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, or a mixture thereof.

In some embodiments, the liquid composition comprises from about 10 wt % to about 65 wt % of one or more surfactants, preferably from about 15 wt % to about 60 wt %, more preferably from about 20 wt % to about 55 wt %, and most preferably from about 30 wt % to about 50 wt %.

In some embodiments, the surfactant system comprises an anionic surfactant, and a non-ionic surfactant.

In some embodiments, the surfactant system further comprises a defoamer. A defoamer is a chemical additive that prevents the formation of foam and/or breaks foam already formed. Examples of commonly used defoamers include fatty acids, polydimethylsiloxanes, silicones, twin chain alcohols and some alcohols, glycols, stearates, and insoluble oils.

In some embodiments, the surfactant system further comprises a zwitterionic surfactant or an amphoteric surfactant. A zwitterionic surfactant is a net-neutrally charged molecule that has positive and negative charges. Some simple amphoteric molecules can only form a net positive or negative charge depending on the pH. Other amphoteric molecules can form a net-neutral charge, depending on the pH. Examples of zwitterionic materials include betaine.

In some embodiments, the anionic surfactant can be linear alkylbenzene sulfonic acid or a salt thereof, alkyl ethoxylated sulphate, alkyl propoxy sulphate, alkyl sulphate, or a mixture thereof.

In some embodiments, the nonionic surfactant can be alcohol ethoxylate, alcohol propoxylate, or a mixture thereof.

In some embodiments, the liquid composition can be substantially free of a sulfate surfactant.

In some embodiments, the surfactant system is present in an amount of about 0.1% to 70%, 1% to 70%, 5% to 70%, 10% to 70%, 20% to 70%, 30% to 70%, 40% to 70%, 50% to 70%, or 60% to 70% by weight of the liquid composition. In some embodiments, the surfactant system is present in an amount of about 0.1% to 60%, 1% to 60%, 5% to 60%, 10% to 60%, 20% to 60%, 30% to 60%, 40% to 60%, or 50% to 60% by weight. In some embodiments, the surfactant system is present in an amount of about 0.1% to 50%, 1% to 50%, 5% to 50%, 10% to 50%, 20% to 50%, 30% to 50%, or 40% to 50% by weight. In some embodiments, the surfactant system is present in an amount of about 30% to 60% by weight. In some embodiments, the surfactant system is present in an amount of about 40% to 50% by weight.

In some embodiments, the anionic surfactant and the non-ionic surfactant are present in a weight ratio of from 1:9 to 9:1, preferably from 3:7 to 7:3, more preferable from 4:6 to 6:4. In some embodiments, the anionic surfactant and the non-ionic surfactant are present in a weight ratio of from 1:9 to 9:1, from 1:8 to 8:1, from 1:7 to 7:1, from 1:6 to 6:1, from 1:5 to 5:1, from 1:4 to 4:1, from 1:3 to 3:1, or from 1:2 to 2:1. In some embodiments, the anionic surfactant and the non-ionic surfactant are present in a weight ratio of from 2:3 to 3:2, from 2:5 to 5:2, from 3:4 to 4:3, from 3:5 to 5:3, or from 3:7 to 7:3. In some embodiments, the anionic surfactant and the non-ionic surfactant are present in a weight ratio of about 1:1.

In some embodiments, the surfactant system comprises (1) a linear alkylbenzene sulfonate (LAS) and/or an alcohol ethoxylsulfate (AES), (2) an alcohol ethoxylate (AE), and (3) a fatty acid.

In some embodiments, the liquid composition of the present disclosure does not contain or is substantially free of a hygroscopic chelant, such as iron and/or manganese chelants, diethylenetriamine pentaacetate, diethylene triamine penta(methyl phosphonic acid), ethylenediamine-N,N'-disuccinic acid, ethylenediamine tetraacetate, ethylenediamine tetra(methylene phosphonic acid), hydroxyethane di(methylene phosphonic acid), 1-hydroxyethanediphosphonic acid and salts thereof, N,N-dicarboxymethyl-2-aminopentane-1,5-dioic acid and salts thereof, and 2-phosphonobutane-1,2,4-tricarboxylic acid and salts thereof.

Linear alkylbenzenesulfonate (LAS) is a water soluble salt of a linear alkyl benzene sulfonate having between 8 and 22 carbon atoms of the linear alkyl group. The salt can be an alkali metal salt, or an ammonium, alkylammonium, or alkanolammonium salt. In one embodiment, the LAS comprises an alkali metal salt of $C_{10}$-$C_{16}$ alkyl benzene sulfonic acids, such as $C_{11}$-$C_{14}$ alkyl benzene sulfonic acids. Suitable LAS includes sodium and potassium linear, alkylbenzene sulfonates in which the average number of carbon atoms in the alkyl group is between 11 and 14. Sodium $C_{11}$-$C_{14}$ (e.g., $C_{12}$) LAS is one suitable anionic surfactant for use herein.

In some embodiments, the amount of LAS in the surfactant system is selected so as to form a structured surfactant system. In some embodiments, the surfactant system contains about 8 to about 25 wt %, about 10 to about 20 wt %, or about 12 to 15 wt % of linear alkylbenzenesulfonate, based on the total weight the surfactant system.

Alcohol ethoxysulfate (AES), also known as alkyl ether sulfates or alkyl polyethoxylate sulfates, are compounds having Formula (I):

$$R_1—O—(C_2H_4O)_n—SO_3M \quad (I),$$

wherein $R_1$ is a $C_8$-$C_{22}$ alkyl group, n is from 1 to 20, and M is a salt-forming cation. Preferably, $R_1$ is a $C_{10}$-$C_{18}$ alkyl, or a $C_{10}$-$C_{15}$ alkyl, n is from 1 to 15, 1 to 10, or 1 to 8, and M is sodium, potassium, ammonium, alkylammonium, or alkanolammonium. More preferably, $R_1$ is a $C_{12}$-$C_{16}$ alkyl, n is from 1 to 6, and M is sodium. In one embodiment, the alkyl ether sulfate is sodium lauryl ether sulphate (SLES). The AES will generally be used in the form of mixtures comprising varying $R_1$ chain lengths and varying degrees of ethoxylation. Frequently such mixtures will inevitably also contain some unethoxylated alkyl sulfate materials, i.e., n=0 in the above Formula (I). Unethoxylated alkyl sulfates may also be added separately to the aqueous surfactant system of present disclosure and used as or in any anionic surfactant component which may be present. Suitable unalkoxylated, e.g., unethoxylated, alkyl ether sulfate surfactants are those made by the sulfation of higher $C_8$-$C_{20}$ fatty alcohols. Conventional alkyl sulfate surfactants may also be suitable herein, which have the general formula of: $R_1OSO_3M^+$, wherein $R_1$ and M each has the same definition as described above.

In some embodiments, the amount of AES in the aqueous surfactant system of the present disclosure is selected so as to form a structured surfactant system. In some embodiments, the surfactant system contains from about 15 to about 45 wt %, about 20 to about 40 wt %, or about 25 to 35 wt % of AES, based on the total weight the surfactant system.

In some embodiments, the weight ratio of LAS to AES in the surfactant system is from about 1:1 to about 1:5, from about 1:1 to about 1:3, or from about 1:2 to about 1:3. In some embodiments, the weight ratio of LAS to AES is about 1:2.5.

The surfactant system of the present disclosure may contain a non-ionic surfactant. A wide range of non-ionic surfactants can be used herein. For example, the non-ionic surfactants include, but are not limited to alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. Preferably, the non-ionic surfactant is an alcohol ethoxylate (AE).

The AE may be primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles, or from 3 to 8 moles of ethylene oxide per mole of alcohol.

Exemplary AEs are the condensation products of aliphatic $C_8$-$C_{20}$, preferably $C_8$-$C_{16}$, primary or secondary, linear or branched chain alcohols with ethylene oxide. In some embodiments, the alcohol ethoxylates contain 1 to 20, or 3 to 8 ethylene oxide groups, and may optionally be end-capped by a hydroxylated alkyl group.

In one embodiment, the AE has Formula (II):

$$R_2—(—O—C_2H_4—)_m—OH \quad (II)$$

wherein $R_2$ is a hydrocarbyl group having 8 to 16 carbon atoms, 8 to 14 carbon atoms, 8 to 12 carbon atoms, or 8 to 10 carbon atoms; and m is from 1 to 20, or 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. Preferably, $R_2$ is a linear or branched $C_8$-$C_{16}$ alkyl, $C_8$-$C_{14}$ alkyl, or $C_8$-$C_{10}$ alkyl group. In case (e.g., commercially available materials) where materials contain a range of carbon chain lengths, these carbon numbers represent an average. The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

One suitable AE has an average degree of ethoxylation of 20.

In some embodiments, the amount of non-ionic surfactant in the surfactant system is selected so as to form a structured surfactant system. In some embodiments, the aqueous surfactant system comprises about 30 to about 70 wt % of a non-ionic surfactant, based on the total weight the surfactant system.

In some embodiments, the surfactant system of the present disclosure comprises from about 30 to about 70 wt %, from about 40 to about 60 wt %, about 45 to about 60 wt %, from about 50 to about 60 wt %, about 45 to about 55 wt %, or about 45 to about 50 wt % of AE, based on the total weight the surfactant system.

In some embodiments, the weight ratio of LAS to non-ionic surfactant (e.g. AE) in the surfactant system is from about 1:1 to about 1:10. In some embodiments, the weight ratio of LAS to AE in the surfactant system is from about 1:1 to about 1:10, from about 1:1 to 1:8, or from about 1:1 to 1:6. In one embodiment, the weight ratio of LAS to AE is about 1:4.

The surfactant system of the present disclosure may contain a fatty acid. Suitable fatty acid may be any fatty acid having formula: $R_3$—C(O)OH, wherein $R_3$ is a $C_5$-$C_{21}$ linear or branched aliphatic group. Preferably, the $R_3$ is a $C_{13}$-$C_{21}$ linear or branched aliphatic group.

In some embodiments, the fatty acid is hexanoic acid, heptanoic acid, octanoic acid, nonanoic acid, capric acid, undecanoic acid, dodecanoic acid (lauric acid), tridecanoic acid, myristic acid, pentadecanoic acid, palmitic acid, heptadecanoic acid, stearic acid, nonadecanoic acid, eicosanoic acid, heneicosanoic acid, docosanoic acid, myristoleic acid, palmitoleic acid, sapienic acid, oleic acid, elaidic acid, vaccenic acid, linoleic acid, linoelaidic acid, arachidonic acid, eicosapentaenoic acid, erucic acid, docosahexaenoic acid, or a mixture thereof.

In some embodiments, the fatty acid is dodecanoic acid (also known as coconut fatty acid).

In some embodiments, the amount of the fatty acid in the surfactant system is selected so as to form a structured surfactant system. In some embodiments, the surfactant system of the present disclosure contains from about 1 to about 15 wt %, from about 1 to about 10 wt %, from about 1 to about 7 wt %, from about 1 to about 6 wt %, from about 1 to 5 wt %, or from 1 about to 4 wt % of fatty acid, based on the total weight the surfactant system. In some embodiments, the surfactant system of the present disclosure contains from about 4 wt % of fatty acid based on the total weight the surfactant system.

In some embodiments, the weight ratio of LAS to fatty acid in the aqueous surfactant system is from about 6:1 to about 1:1, from about 5:1 to about 1:1, from about 4:1 to about 1:1, or from about 3:1 to about 1:1. In one embodiment, the weight ratio of LAS to fatty acid is about 3:1.

In some embodiments, the weight ratio of LAS:AES:AE in the surfactant system is about 0.9-1.1:1.8-2.2:2.7-3.3. In one embodiment, the weight ratio of LAS:AES:AE is about 1:2:3.

In one embodiment, the surfactant system of the present disclosure contains about 10 to 15 wt % LAS, about 30 to 35 wt % AES, about 50 to 55 wt % of AE, and about 3 to 5 wt % fatty acid based on the total weight the surfactant system.

In one embodiment, the surfactant system of the present disclosure contains about 13 wt % LAS, about 31 wt % AES, about 52 wt % of AE, and about 4 wt % fatty acid based on the total weight the surfactant system.

Fragrance Composition

In some embodiments, the beneficial composition comprises a fragrance or fragrance composition.

Fragrance (perfume) refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance can comprise an ester, an ether, an aldehyde, a ketone, an alcohol, a hydrocarbon, or a mixture thereof.

Typically, perfumes are complex mixtures of blends of various organic compounds such as alcohols, aldehydes, ethers, aromatic compounds and varying amounts of essential oils (e.g., terpenes). The essential oils themselves are volatile odoriferous compounds and also serve to dissolve the other components of the perfume. Suitable perfume ingredients include those disclosed in "Perfume and Flavour Chemicals (Aroma Chemicals)," published by Steffen Arctander (1969), which is incorporated herein by reference.

In some embodiments, the fragrance component is in the form of free fragrance. In some embodiments, at least some of the fragrance can be encapsulated in, for example, water-insoluble shell, microcapsule, nanocapsule or any combination thereof. The microcapsules can be water-soluble or water-insoluble.

Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety.

The fragrance (perfume) can have, for example, a musky scent, a putrid scent, a pungent scent, a camphoraceous scent, an ethereal scent, a floral scent, a peppermint scent, or any combination thereof. The fragrance comprises methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

Exemplary fragrances include HIGH FIVE ACM 190991 F (Firmenich), SUPER SOFT POP 190870 (Firmenich), MAYFLOWERS TD 485531 EB (Firmenich), or any combination thereof. Other known fragrances, or any fragrance commercially available from a fragrance supplier (e.g., Firmenich, Givaudan, etc.), or combinations of such fragrances, may also suitably be used herein.

Color Care Agent

In some embodiments, the beneficial composition comprises a color care agent.

Color care agents have the ability to prevent color fading or color shifting of the dyes within the fabric or to protect colored fabrics in a wash, such as the ability to improve, enhance, or modify stiffness (resilience), softness, smoothness, drape, and/or wrinkle recovery (elastic recoverability) properties. In one embodiment, a color care agent has the ability to protect colored fabrics in a chlorinated wash. In another embodiment, a color care agent has the ability to protect colored fabrics in a non-chlorinated wash. A color care agent mixture comprises at least two color care agents, such as at least three color care agents.

In some embodiments, the color care agent may be ammonium chloride, a polyvinylpyrrolidone homopolymer, a vinylimidazole homopolymer, a polyvinylpyrrolidone-vinylimidazole copolymer, monoethanolamine, iminodisuccinic acid, and a polyethyleneimine (PEI), a polyethyleneimine salt, or mixtures thereof. For example, the color care agent mixture may comprise ammonium chloride and a polyvinylpyrrolidone-vinylimidazole copolymer. The color care agent mixture may comprise a polyvinylpyrrolidone-vinylimidazole copolymer and a PEI, a PEI salt, or mixtures thereof, such as a color care agent mixture. The color care agent mixture may comprise at least three color care agents. For example, the color care agent mixture may comprise ammonium chloride, a polyvinylpyrrolidone-vinylimidazole copolymer, and a PEI, a PEI salt, or mixtures thereof.

Softening Agent

In some embodiments, the beneficial composition comprises a softening agent.

The softening agent may be a polysiloxane, a textile-softening clay, a cationic polymer, a cellulase enzyme, a quaternary cationic ammonium, or any combination thereof. If the fabric softener is a textile-softening clay, it may be a smectite clay, including a Bentonite clay, Beidellite clay, a Hectorite clay, a Laponite clay, a Montmorillonite clay, a Nontronite clay, a Saponite clay, a Sauconite, clay, or any combination thereof. Clay softeners can be used in combination with amine and cationic softeners, as disclosed, for example, in U.S. Pat. Nos. 4,375,416 and 4,291,071. Mixtures of cellulase enzymes and clays are also useful as high-performance fabric softeners. Various nonionic and cationic materials can be added to enhance static control such as $C_8$-$C_{18}$ dimethylamino propyl glucamide, $C_8$-$C_{18}$ trimethylamino propyl glucamide ammonium chloride and the like.

Other Ingredients in the Beneficial Composition

The liquid composition of the present disclosure may also contain other ingredients that can be added to the beneficial composition including, but not limited to, a whitening agent, a brightening agent, a color/texture rejuvenating agent, a bleaching catalyst, a bleaching agent, a bleach activator, a buffer, a surfactant stabilizer, a neutralization agent, a builder, an enzyme, a dye (colorant), a dispersing agent, a defoamer, an anticorrosion agent, a deodorizing agent, an anti-redeposition agent, a soil releasing polymer, a preservative, a bittering agent, a biocidal agent, or a combination thereof.

Suitable brightening agents include stilbenes; distyrylbiphenyl derivatives, stilbene/naphthotriazole blends, oxazole derivatives, or coumarin brighteners.

The liquid composition of the present disclosure may contain a buffer. A wide range of buffers can be used herein. For example, the buffer may comprise a citrate or a formate, and optionally an amine (e.g., triethanolamine). In some embodiments, the liquid composition contains from about 1 to about 15 wt %, preferably from about 5 to about 10 wt % of the buffer, based on the total weight of the liquid composition.

The liquid composition of the present disclosure may contain a surfactant stabilizer. Examples of the surfactant stabilizer include, but are not limited to, polysorbate, quillaja extract, octenyl succinic anhydride (OSA) modified starch, gum acacia, modified gum acacia, and a mixture thereof.

Suitable builders include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071.

The liquid composition may contain a neutralization agent. The neutralization agent comprises a hydroxide, an alkanolamine, or a mixture thereof. Examples of the neutralization agent include, but are not limited to, monoethanolamine, diethanolamine, triethanolamine, isopropylamine, sodium hydroxide, potassium hydroxide, ammonium hydroxide, calcium hydroxide, or the like, and a mixture thereof.

Suitable enzymes include those known in the art, such as amylolytic, proteolytic, cellulolytic or lipolytic types, and those listed in U.S. Pat. No. 5,958,864. One preferred protease is a subtillase from *Bacillus lentus*. Other suitable enzymes include proteases, amylases, lipases and cellulases. Also suitable for use in the present disclosure are blends of two or more of these enzymes, for example a protease/lipase blend, a protease/amylase blend, a protease/amylase/lipase blend, and the like.

A variety of dye colors can be used, such as blue, yellow, green, orange, purple, clear, etc. Suitable dyes include, but are not limited to chromophore types, e.g., azo, anthraquinone, triarylmethane, methine quinophthalone, azine, oxazine thiazine, which may be of any desired color, hue or shade.

Suitable biocidal agents include an anti-microbial, a germicide, or a fungicide. For example, a biocidal agent includes triclosan (5-chloro-2-(2,4-dichloro-phenoxy) phenol)), and the like.

Suitable foam stabilizing agents include a polyalkoxylated alkanolamide, amide, amine oxide, betaine, sultaine, $C_8$-$C_{18}$ fatty alcohols, and those disclosed in U.S. Pat. No. 5,616,781. An auxiliary foam stabilizing surfactant, such as a fatty acid amide surfactant, may also be included in the liquid composition disclosed herein. Suitable fatty acid amides include $C_8$-$C_{20}$ alkanol amides, monoethanolamides, diethanolamides, or isopropanolamides.

Suitable anti-redeposition agents are typically polycarboxylate materials. Polycarboxylate materials, which can be prepared by polymerizing or copolymerizing suitable unsaturated monomers, are admixed in their acid form. Unsaturated monomeric acids that can be polymerized to form suitable polycarboxylates include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40 wt % of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials (e.g., those described in U.S. Pat. No. 3,308,067). In one embodiment, the polycarboxylate is sodium polyacrylate.

Acrylic/maleic-based copolymers may also be used as a component of the anti-redeposition agent. Such materials include the water-soluble salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers are known materials (e.g., those described in EP 193360). Other useful polymers include maleic/acrylic/vinyl alcohol terpolymers (e.g., a terpolymer containing 45/43/10 of acrylic/maleic/vinyl alcohol as described in EP 193360).

In addition to its role as a solvent, polyethylene glycol can act as a clay soil removal-anti-redeposition agent. Molecular weight of suitable polyethylene glycol can range from about 1,000 to about 50,000, or about 3,000 to about 10,000. Polyaspartate and polyglutamate dispersing agents may also be used herein.

Any polymeric soil release agent known to those skilled in the art can optionally be employed herein as well. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Suitable soil-releasing polymers include, but are not limited to, anionic hydrophobic polysaccharides of the type as disclosed in U.S. Pat. No. 6,764,992. Each of the patent references is incorporated herein by reference in its entirety.

Any suitable process known to those skilled in the arts of cleaning, color care, fragrance or softening compositions can be used to make the liquid compositions of the present disclosure.

Uses

The liquid composition or unit dose composition of the present disclosure can be added to a wash liquor to which laundry is present, or to which laundry will be added. It may be used in combination with other laundry detergent compositions, such as, e.g., fabric softeners or stain removers. It may also be used in an automatic washing machine operation and added directly to the drum or to the dispenser drawer of the machine.

The unit dose composition of the present disclosure can be added to a wash liquor to which dishes are present, or to which dishes will be added. It may also be used in an automatic dishwashing machine operation and added directly to the drum or to the dispenser drawer of the machine.

In some embodiments, the unit dose composition of the present disclosure is substantially free of efflorescence. Efflorescence is a phenomenon when solvated salts precipitate out, on, or in the film.

EXAMPLES

The following examples are illustrative and non-limiting of the compositions of the present invention. Suitable modifications and adaptations of the variety of conditions, formulations, and other parameters normally encountered in the field and which are obvious to those skilled in the art in view of this disclosure are within the spirit and scope of the invention.

Example 1: Unit Dose Composition

As shown in Table 1, unit dose compositions were prepared by incorporating solvents, polymers, enzymes, chelators, fragrances, and other functional materials commonly used in a finished product. 2-methyl-1,3-propanediol (MP Diol), polyethylene glycol 400 (PEG 400), diethylene glycol butyl ether (Butyl Carbitol), and ethylene glycol monobutyl ether (Butyl Cellosolve) were added as the fifth solvent ("inventive" samples B-E). As a comparison, "traditional sample" F contained four solvents, consisting of water, propylene glycol (PG), Glycerin (Gly), and Tris (2-hydroxyethyl) methyl-ammonium methylsulfate (an ionic liquid).

TABLE 1

| | | | | Inventive | | | | Comparative PG/Gly |
|---|---|---|---|---|---|---|---|---|
| | % Activity | Water Content | Control Water A | MP Diol B | PEG 400 C | Butyl Carbitol D | Butyl Cellosolve E | (Traditional Sample) F |
| C12-C15 Alcohol Ethoxylate 7EO | 99.85 | 0.2 | 23.07 | 23.07 | 23.07 | 23.07 | 23.07 | 23.07 |

TABLE 1-continued

| | % Activity | Water Content | Control Water A | Inventive MP Diol B | Inventive PEG 400 C | Inventive Butyl Carbitol D | Inventive Butyl Cellosolve E | Comparative PG/Gly (Traditional Sample) F |
|---|---|---|---|---|---|---|---|---|
| Propylene Glycol | 99.9 | 0.12 | 5.00 | 5.00 | 5.00 | 5.00 | 5.00 | 7.76 |
| Zeolite Water | 100 | 100 | 15.53 | 10.00 | 10.00 | 10.00 | 10.00 | 10.00 |
| Optical Brightener | 100 | 0 | 0.30 | 0.30 | 0.30 | 0.30 | 0.30 | 0.30 |
| Glycerin | 99.85 | 0.25 | 5.00 | 5.00 | 5.00 | 5.00 | 5.00 | 7.76 |
| Tris (2-hydroxyethyl) methyl-ammonium methylsulfate | 100 | 0 | 15.00 | 15.00 | 15.00 | 15.00 | 15.00 | 15.00 |
| Bitrex | 25 | 0 | 0.05 | 0.05 | 0.05 | 0.05 | 0.05 | 0.05 |
| Sodium lauryl ether sulphate (3EO) | 60 | 24.5 | 26.00 | 26.00 | 26.00 | 26.00 | 26.00 | 26.00 |
| 50% NaOH | 50 | 49 | 1.10 | 1.10 | 1.10 | 1.10 | 1.10 | 1.10 |
| Coconut Fatty Acids | 100 | 0 | 4.00 | 4.00 | 4.00 | 4.00 | 4.00 | 4.00 |
| Anti-redeposition agent | 44 | 50 | 1.50 | 1.50 | 1.50 | 1.50 | 1.50 | 1.50 |
| IDS | 33 | 66 | 0.90 | 0.90 | 0.90 | 0.90 | 0.90 | 0.90 |
| Mannanase Enzyme | about 8 | 50 | 0.60 | 0.60 | 0.60 | 0.60 | 0.60 | 0.60 |
| Amylase Enzyme | about 8 | 50 | 0.35 | 0.35 | 0.35 | 0.35 | 0.35 | 0.35 |
| Protease Enzyme | about 8 | 50 | 1.60 | 1.60 | 1.60 | 1.60 | 1.60 | 1.60 |
| MP Diol | 100 | 0 | | 5.53 | | | | |
| PEG 400 | 100 | 0 | | | 5.53 | | | |
| Butyl Carbitol | 100 | 0 | | | | 5.53 | | |
| Butyl Cellosolve | 100 | 0 | | | | | 5.53 | |
| Total no added Water | | | 84.47 | 90.00 | 90.00 | 90.00 | 90.00 | 90.00 |
| Total | | | 100.00 | 100.00 | 100.00 | 100.00 | 100.00 | 100.00 |

Example 2: Stability Testing of a Multi-Chamber Pack with Five Solvents

The liquid composition prepared according to Table 1 was placed into a multi-chamber pack. The multi-chamber pack has two outer chambers each containing 11 grams of liquid composition according to Table 1 and an empty center chamber that was filled with 2.5 grams of powder material. Pacs were created using two different PVOH water-soluble films: MonoSol film M8312 and MonoSol film M8720. Pacs were placed into temperature controlled environment at 68° F. (20° C.), and observations and analyses were performed over a period of time. Height of the chamber was measured over 48 hours and over 3 months as an indicator of pack rigidity. Height of the chamber was measured by Ames Logic Basic Digital Comparator Model BG1110-1-04, on a column mounted indicator, model 99-0697. Height of the sample was measured by placing pack under digital indicator, after the scale was zeroed.

As shown in Table 2, the addition of a fifth solvent, such as, MP Diol, PEG, or glycol ether showed various improvements over comparative samples with no additional fifth solvent added. More specifically, the addition of PEG 400 or butyl carbitol improved pack rigidity (i.e. height) by up to 15% over 48 hours and over 3 months.

TABLE 2

| | Control Water A | Inventive MP Diol B | Inventive PEG 400 C | Inventive Butyl Carbitol D | Inventive Butyl Cellosolve E | Comparative PG/Gly (Traditional Sample) F |
|---|---|---|---|---|---|---|
| Approx. Total Solvent | 53.24 | 53.24 | 53.24 | 53.24 | 53.24 | 53.25 |
| Water | 25.12 | 19.59 | 19.59 | 19.59 | 19.59 | 19.60 |
| Glycerin | 5.00 | 5.00 | 5.00 | 5.00 | 5.00 | 7.76 |
| Propylene Glycol | 5.00 | 5.00 | 5.00 | 5.00 | 5.00 | 7.76 |
| Tris (2-hydroxyethyl) methyl-ammonium methylsulfate | 15.00 | 15.00 | 15.00 | 15.00 | 15.00 | 15.00 |
| Inventive: Additional Non-Aq. Solvent (MP Diol, PEG, or Glycol Ether) | 0.00 | 5.53 | 5.53 | 5.53 | 5.53 | 0.00 |
| Pack Height in M8720 48 hr at 20° C. (inches) | 0.46 | 0.51 | 0.56 | 0.55 | 0.54 | 0.50 |
| Improvement over Traditional Sample F | −8.00% | 2.00% | 12.00% | 10.00% | 8.00% | N/A |
| Pack Height in M8312 48 hr at 20° C. (inches) | 0.45 | 0.49 | 0.54 | 0.54 | 0.51 | 0.47 |

TABLE 2-continued

| | Control Water A | Inventive MP Diol B | PEG 400 C | Butyl Carbitol D | Butyl Cellosolve E | Comparative PG/Gly (Traditional Sample) F |
|---|---|---|---|---|---|---|
| Improvement over Traditional Sample F | −4.26% | 4.26% | 14.89% | 14.89% | 8.51% | N/A |
| Pack Height in M8720 3 months at 20° C. (inches) | 0.45 | 0.485 | 0.50 | 0.495 | 0.495 | 0.47 |
| Improvement over Traditional Sample F | −4.26% | 3.19% | 6.38% | 5.32% | 5.32% | N/A |
| Pack Height in M8312 3 months at 20° C. (inches) | 0.41 | 0.415 | 0.47 | 0.47 | 0.445 | 0.41 |
| Improvement over Traditional Sample F | 0% | 1.22% | 14.63% | 14.63% | 8.54% | N/A |

Example 3: Rigidity Test

Pacs prepared as shown in Table 1 and Table 2 were placed into a temperature controlled environment at 68° F. (20° C.), and studied over 24 hours. Pack rigidity was graded on a 1 to 5 scale with 5 being most floppy and 1 being most firm. As shown in Table 3, Formulas B-E with the addition of a fifth solvent, such as, MP Diol, PEG 400, butyl barbitol, butyl cellosolve, showed improvement of rigidity over a comparative sample (Formula F).

TABLE 3

| Formula | Material used | Film Type M8312 Rigidity Rating at 24 hours at 20° C. | M8720 |
|---|---|---|---|
| A | Extra Water | 5 | 5 |
| B | MP Diol | 3 | 3 |
| C | PEG 400 | 2 | 1.5 |
| D | Butyl Carbitol | 3 | 2 |
| E | Butyl Cellosolve | 2 | 2 |
| F | 50% Propylene + 50% Glycerin | 4 | 3.5 |

The breadth and scope of the present invention should not be limited by any of the above-described exemplary embodiments, but should be defined only in accordance with the following claims and their equivalents.

All publications, patent applications, patents, and other references mentioned herein are incorporated by reference in their entirety. In case of conflict, the present specification, including definitions, will control. In addition, section headings, the materials, methods, and examples are illustrative only and not intended to be limiting.

What is claimed is:

1. A unit dose product comprising:

(a) a container formed from a water-soluble or water-dispersible film material; and (b) a liquid composition comprising:

(i) a solvent system comprising water and at least four non-aqueous solvents, wherein said solvent system totals from about 35% to about 80% weight of the liquid composition; and (ii) a beneficial composition;

wherein the container entraps the liquid composition;

wherein the non-aqueous solvents are glycerin, propylene glycol, ionic liquid, and at least one of polyethylene glycol, diethylene glycol monobutyl ether, and ethylene glycol monobutyl ether;

wherein the ionic liquid is tris (2-hydroxyethyl)methyl ammonium methylsulfate; and wherein the ionic liquid is present at about 2 to 5 times by weight of any other non-aqueous solvent.

2. The unit dose product of claim 1, wherein the liquid composition comprises from about 25% to about 75% by weight of the combined non-aqueous solvents; and wherein any non-aqueous solvent is no more than 30% by weight of the liquid composition.

3. The unit dose product of claim 1, wherein the beneficial composition comprises a surfactant system, a fragrance composition, a color care agent, a softening agent, or a combination thereof; and wherein the surfactant system comprises:

(a) an anionic surfactant, and (b) a non-ionic surfactant.

4. The unit dose product of claim 3, wherein the nonionic surfactant is selected from the group consisting of polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, amine oxide surfactants, alkoxylated fatty alcohols, and a mixture thereof; and wherein the anionic surfactant is linear alkylbenzene sulfonic acid or a salt thereof, alkyl ethoxylated sulphate, alkyl propoxy sulphate, or alkyl sulphate, or a mixture thereof.

5. The unit dose product of claim 1, wherein the beneficial composition comprises a surfactant system comprising:

(a) a linear alkylbenzene sulfonate (LAS) and/or an alcohol ethoxylsulfate (AES);

(b) an alcohol ethoxylate (AE); and (c) a fatty acid.

6. The unit dose product of claim 5, wherein the LAS is present in an amount of about 10% to about 20% by weight of the surfactant system;

wherein the AES is present in an amount of about 20% to about 40% by weight of the surfactant system;

wherein the AE is present in an amount of about 30% to about 70% by weight of the surfactant system; and wherein the fatty acid is present in an amount of about 1% to about 15% by weight of the surfactant system.

7. The unit dose product of claim 5, wherein the LAS and the AES are present in a weight ratio of from about 1:1 to about 1:5.

8. The unit dose product of claim 5, wherein the LAS and the AE are present in a weight ratio of from about 1:1 to about 1:10.

9. The unit dose product of claim 5, wherein the LAS and the fatty acid are present in a weight ratio of from about 6:1 to about 1:1.

10. The unit dose product of claim 1, wherein the liquid composition is substantially free of a sulphate surfactant.

11. The unit dose product of claim 1, wherein the non-aqueous solvents further comprise polyols selected from a group consisting of 2-methyl 1,3-propanediol, 1,3-propanediol, 1,5-pentanediol, hexylene glycol, and a combination thereof.

12. The unit dose product of claim 1, wherein the non-aqueous solvents further comprise glycol ethers selected from a group consisting of triethylene glycol monobutyl ether, ethylene glycol monopropyl ether, diethylene glycol monoethyl ether, triethylene glycol monoethyl ether, diethylene glycol monomethyl ether, triethylene glycol monomethyl ether, and a combination thereof.

13. The unit dose product of claim 1, wherein the polyethylene glycol is selected from a group consisting of PEG 300, PEG 400, PEG 600, PEG 800, PEG1000, and a mixture thereof.

14. A unit dose product comprising:

(a) a container formed from a water-soluble or water-dispersible film material; and (b) a liquid composition comprising:

(i) a solvent system comprising water and at least four non-aqueous solvents, wherein said solvent system totals from about 35% to about 80% weight of the liquid composition; and (ii) a beneficial composition;

wherein the container entraps the liquid composition;

wherein the at least four non-aqueous solvents are chosen from ionic liquids, glycol ethers, ethylene oxide/propylene oxide (EO/PO) block copolymers, polyethylene glycols, and mixtures thereof; and wherein the solvent system includes one or more EO/PO block copolymers, and molecular weight of the EO/PO block copolymer is less than 3500, with the EO portion at least 60% of the EO/PO molecule.

15. The unit dose product of claim 14, wherein the liquid composition comprises from about 25% to about 75% by weight of the combined non-aqueous solvents; and wherein any non-aqueous solvent is no more than 30% by weight of the liquid composition.

16. The unit dose product of claim 14, wherein the glycol ethers are selected from a group consisting of ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, triethylene glycol monomethyl ether, and a combination thereof.

17. The unit dose product of claim 14, wherein the polyethylene glycols are selected from a group consisting of PEG 300, PEG 400, PEG 600, PEG 800, PEG1000, and a mixture thereof.

18. The unit dose product of claim 14, wherein the beneficial composition comprises a surfactant system comprising:

(d) a linear alkylbenzene sulfonate (LAS) and/or an alcohol ethoxylsulfate (AES);

(e) an alcohol ethoxylate (AE); and (f) a fatty acid.

* * * * *